US012102273B2

(12) United States Patent
Hartz

(10) Patent No.: US 12,102,273 B2
(45) Date of Patent: Oct. 1, 2024

(54) MOBILE HAND CLEANING STATION

(71) Applicant: Handwash HQ, Corp., Nashville, TN (US)

(72) Inventor: J. Trevor Hartz, Nashville, TN (US)

(73) Assignee: Handwash HQ, Corp., Nashville, TN (US)

( * ) Notice: Subject to any disclaimer, the term of this patent is extended or adjusted under 35 U.S.C. 154(b) by 353 days.

(21) Appl. No.: 17/482,728

(22) Filed: Sep. 23, 2021

(65) Prior Publication Data

US 2022/0087485 A1 Mar. 24, 2022

Related U.S. Application Data

(60) Provisional application No. 63/081,988, filed on Sep. 23, 2020.

(51) Int. Cl.

| | |
|---|---|
| ***A47K 5/12*** | (2006.01) |
| ***A45F 5/00*** | (2006.01) |
| ***A47K 5/122*** | (2006.01) |

(52) U.S. Cl.

CPC ..... *A47K 5/1201* (2013.01); *A45F 5/00* (2013.01); *A47K 5/122* (2013.01); *A45F 2005/002* (2013.01)

(58) Field of Classification Search

CPC .... A47K 5/1201; A47K 5/122; A47K 5/1214; A45F 2005/002; A45F 2005/006; A45F 2200/05; A45F 2003/003; A45F 2003/008; Y10S 220/916; Y10S 220/903

USPC ..... 224/148.4, 148.1–148.3, 148.5–148.7; 222/175, 181.2

See application file for complete search history.

(56) References Cited

U.S. PATENT DOCUMENTS

| | | | | |
|---|---|---|---|---|
| 3,814,288 | A * | 6/1974 | Westrich | B65D 81/3886 224/601 |
| 3,830,270 | A * | 8/1974 | Hagert | B65D 81/3876 D9/527 |
| 5,318,084 | A * | 6/1994 | Jackson | A45F 3/00 224/264 |
| 5,954,238 | A * | 9/1999 | Rausch | A45F 5/00 220/903 |
| 2013/0098954 | A1* | 4/2013 | Inglis | A45F 5/00 224/148.4 |
| 2022/0061595 | A1* | 3/2022 | Siegel | B65D 83/0061 |

* cited by examiner

*Primary Examiner* — Adam J Waggenspack
(74) *Attorney, Agent, or Firm* — Mark A. Pitchford; Eric B. Fugett; Pitchford Fugett, PLLC

(57) ABSTRACT

A mobile hand cleaning station allows both hands to be cleaned with a minimal interaction of dirty hand(s) with the sanitizing apparatus. This device has the capability of containing and dispensing multiple flowable (e.g., liquid, gel, or foam) elements, such as a cleaning agent and water. The station includes an attachment point configured to balance the container(s) with their dispensing ends in a downward, but not straight down, orientation when the station is hung from the attachment point.

10 Claims, 8 Drawing Sheets

MOBILE HAND CLEANING STATION

CROSS-REFERENCES TO RELATED APPLICATIONS

This application claims priority to and hereby incorporates by reference in its entirety U.S. Provisional Patent Application No. 63/081,988 entitled "Mobile Hand Washing Device" filed on Sep. 23, 2020.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates to a hand sanitizing device. More particularly, the present disclosure relates to an apparatus and device that can allow the sanitizing of hands, or cleaning of hands, at a location remote from clean running water, such as a job site or "field location."

Prior art hand cleaning apparatuses known take various forms and coordinate with various liquids and/or chemicals to clean one's hands. Most prior art hand sanitizing items require the use of running water and/or electricity. Other hand sanitizing or hand cleaning devices use battery powered elements (e.g. ultraviolet hand sanitation systems) or require full use of a hand for proper operation of the device.

Some examples of the prior devices include U.S. Pat. Nos. 4,023,712; 6,234,357; 6,283,334; and 7,988,020. Other prior devices include U.S. Publication Nos. 2006/0078484; 2008/0110773; 2010/0238021; 2010/0102085; and 2013/0048678. Most prior art devices require the manipulation of the cleaning agent by one hand to dispense that cleaning agent into the other hand. These conventional devices only have a single cleaning agent option. Requiring the use of one of the user's hands to dispense the fluid from the container into the user's other open or empty hand can compromise the cleanliness of the exterior of the container of the cleaning agent. Additionally, these conventional dispenser systems do not contemplate the use of water in the cleaning process and rely instead only on an evaporating chemical to clean the hands (e.g., isopropyl alcohol mixtures). Water has been found to be one of the better cleaning substances when used in combination with an antibacterial cleanser.

BRIEF SUMMARY OF THE INVENTION

Aspects of the present invention provide a mobile hand cleaning station that allows both hands to be cleaned with a minimal interaction of dirty hand(s) with the sanitizing apparatus. This device has the capability of containing and dispensing multiple flowable (e.g., liquid, gel, or foam) elements, such as a cleaning agent and water. The station includes an attachment point configured to balance the container(s) with their dispensing ends in a downward, but not straight down, orientation when the station is hung from the attachment point.

In one aspect, and mobile hand cleaning station includes a container of flowable product, and a carrier. The container of flowable product includes a dispenser, and the container is configured to receive flowable product therein and selectively dispense said flowable product through the dispenser. The carrier includes a central containment area and an attachment point. The central containment area extends along a longitudinal axis of the container when the container is received in the central containment area. The central containment area is configured to receive the container flowable product. The central containment area has a first end configured to receive the campaigner into the central containment area. The central containment area has a second end opposite the first end. The second end of the central containment area has an opening therethrough to receive the dispenser of the container when the container is in the central containment area. The opening in the second end of the central containment area does not permit the whole container to pass therethrough such that when the container is inserted into the central containment area through the first end of the central containment area, the dispenser passes through the opening in the second end of the central containment area and the container is retained in the central containment area. The attachment point is configured to connect to an attachment device of the mobile hand cleaning station. The attachment point is located on the carrier between the first end of the central containment area and the second end of the central containment area.

In another aspect, a carrier for a mobile hand cleaning station includes a central containment area and an attachment point. The central containment area extends along the longitudinal axis of a container when the container is received in the central containment area. The central containment area is configured to receive the container of flowable product. The container has a dispenser. The central containment area has a first end configured to receive the container into the central containment area. The central containment area has a second end opposite the first end, and the second end has an opening therethrough to receive the dispenser of the container when the container is in the central containment area. The opening in the second end of the central containment area does not permit the whole container to pass therethrough such that when the container is inserted into the central containment area through the first end of the central containment area, the dispenser passes through the opening in the second end of the central containment area and the container is retained in the central containment area. The attachment point is configured to connect to an attachment device of the mobile hand cleaning station. The attachment point is located on the carrier between the first end of the central containment area and the second end of the central containment area.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
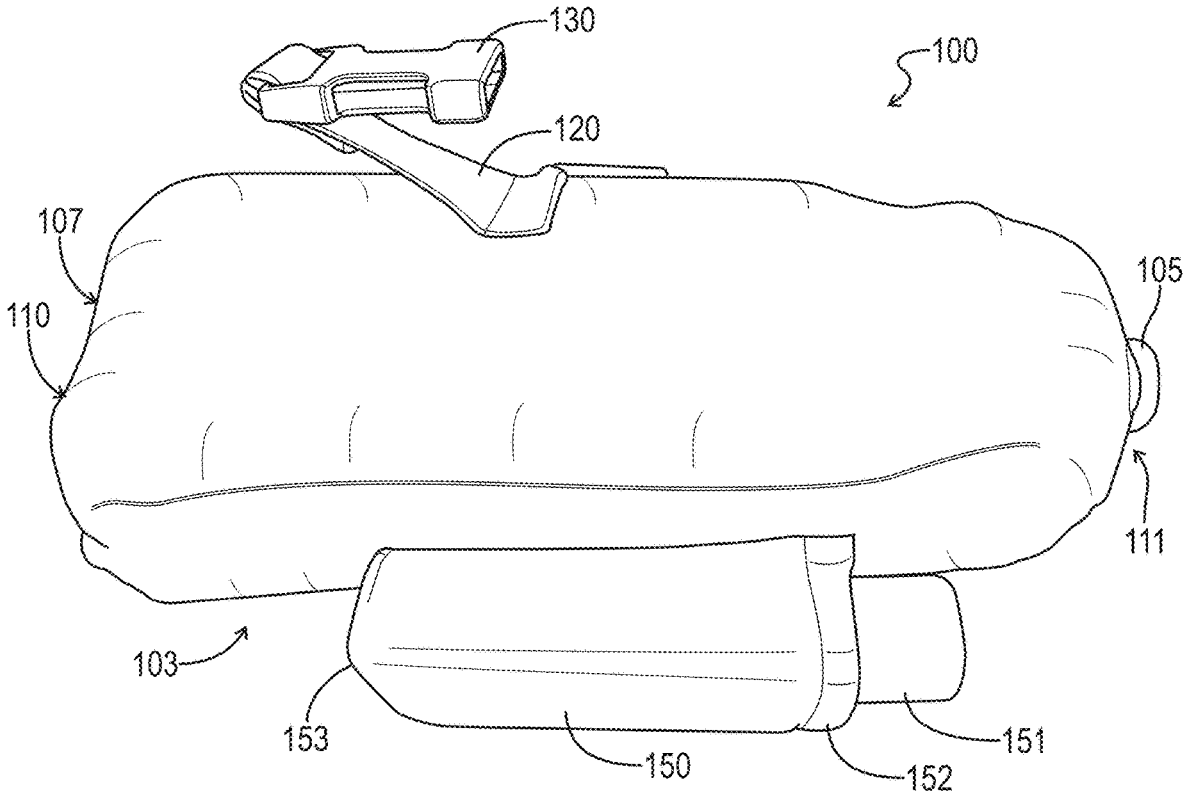
FIG. 1 is a side perspective view of a mobile hand cleaning station.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of the mobile hand cleaning station is hanging from the attachment point such that the longitudinal axis along which the central containment area of the carrier extends is neither horizontal nor vertical and the second end (dispensing end) of the central containment area is lower than the first end (insertion end) of the central containment area. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 2:
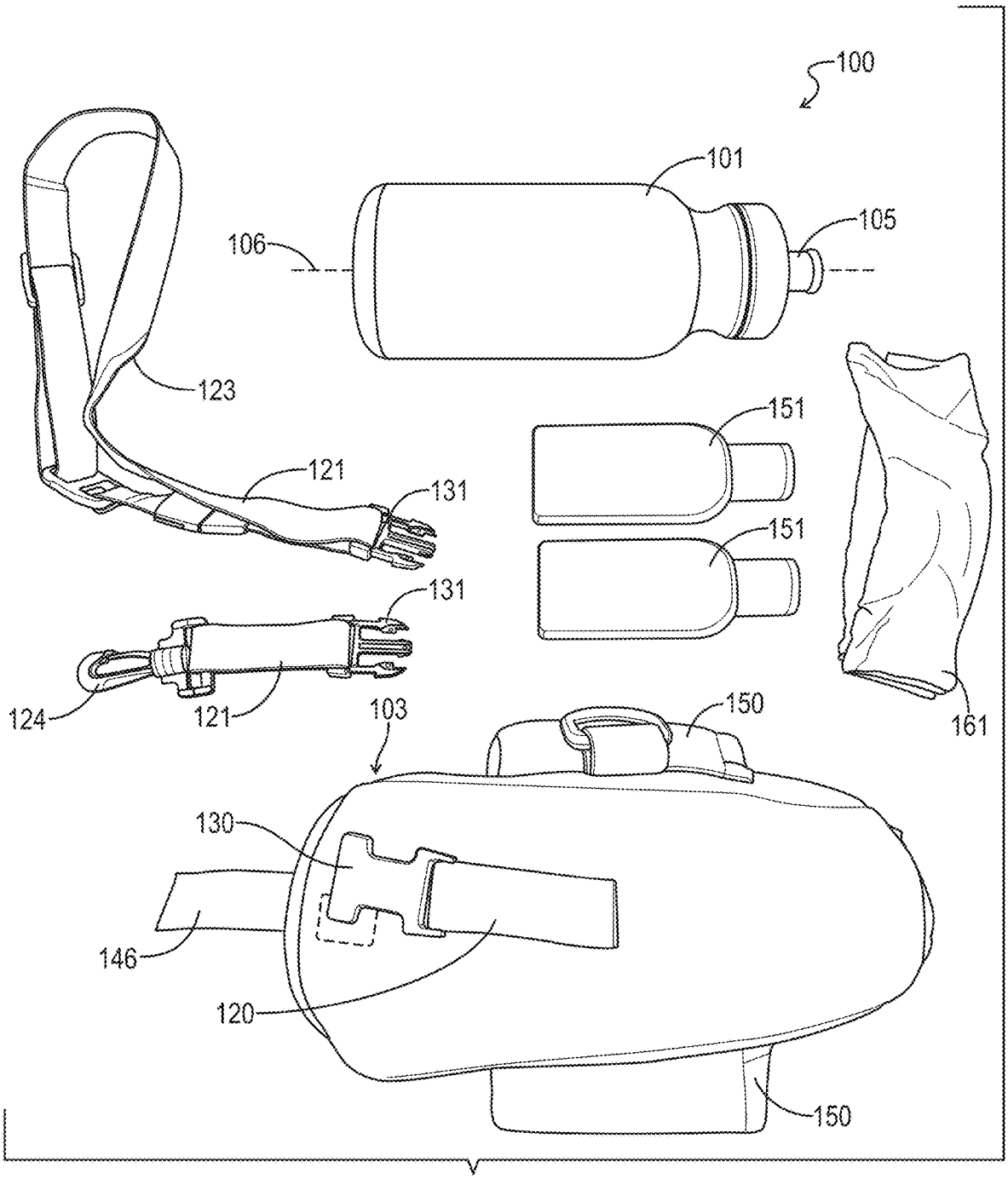
FIG. 2 is an exploded perspective view of the mobile hand cleaning station of FIG. 1.
Figure 3:
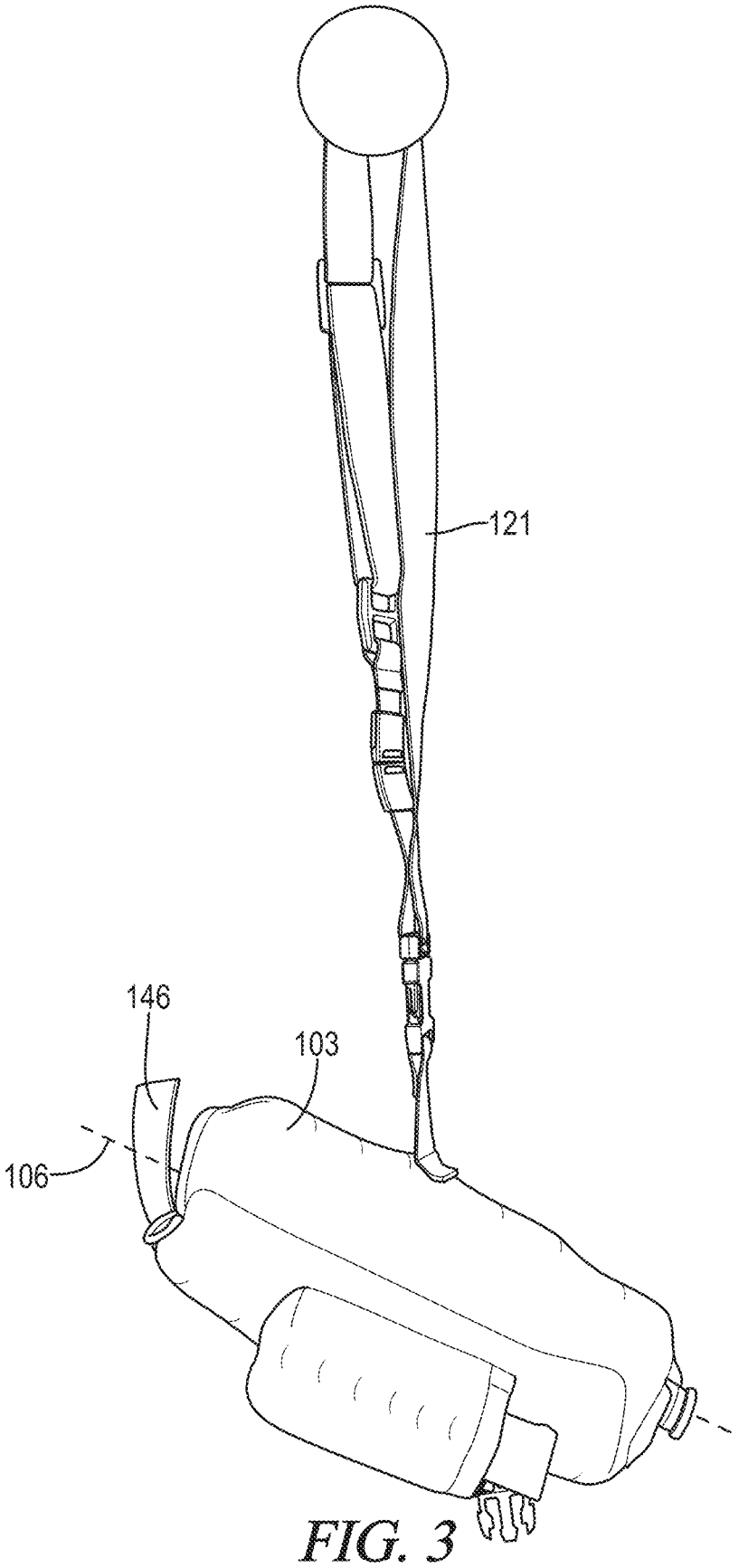
FIG. 3 is a side perspective view of the mobile hand cleaning station of FIG. 1.
Figure 4:
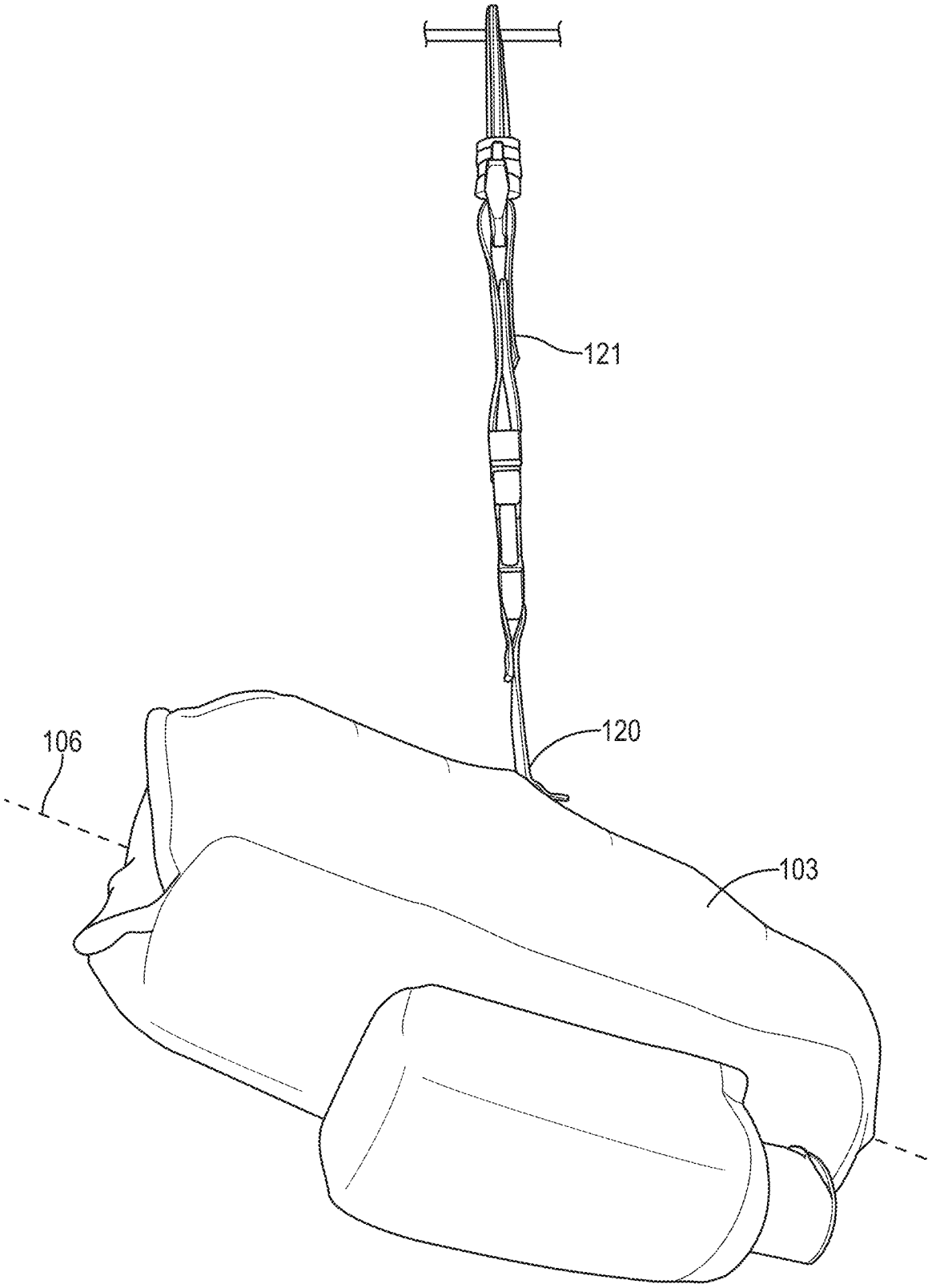
FIG. 4 is a side perspective view of the mobile hand cleaning station of FIG. 1.
Figure 5:
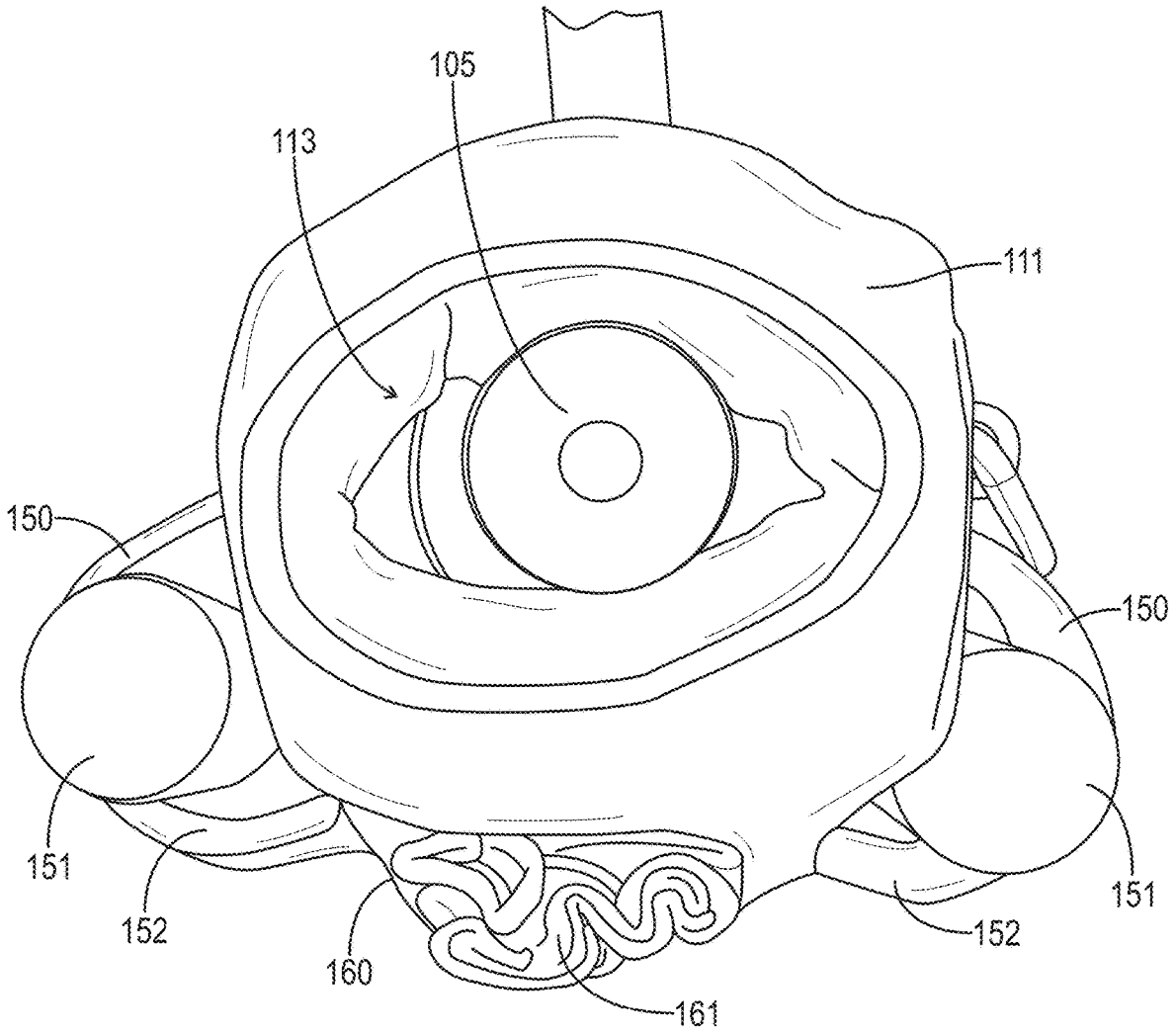
FIG. 5 is an end perspective view of the mobile hand cleaning station of FIG. 1 from a second end of the mobile hand cleaning station.
Figure 6:
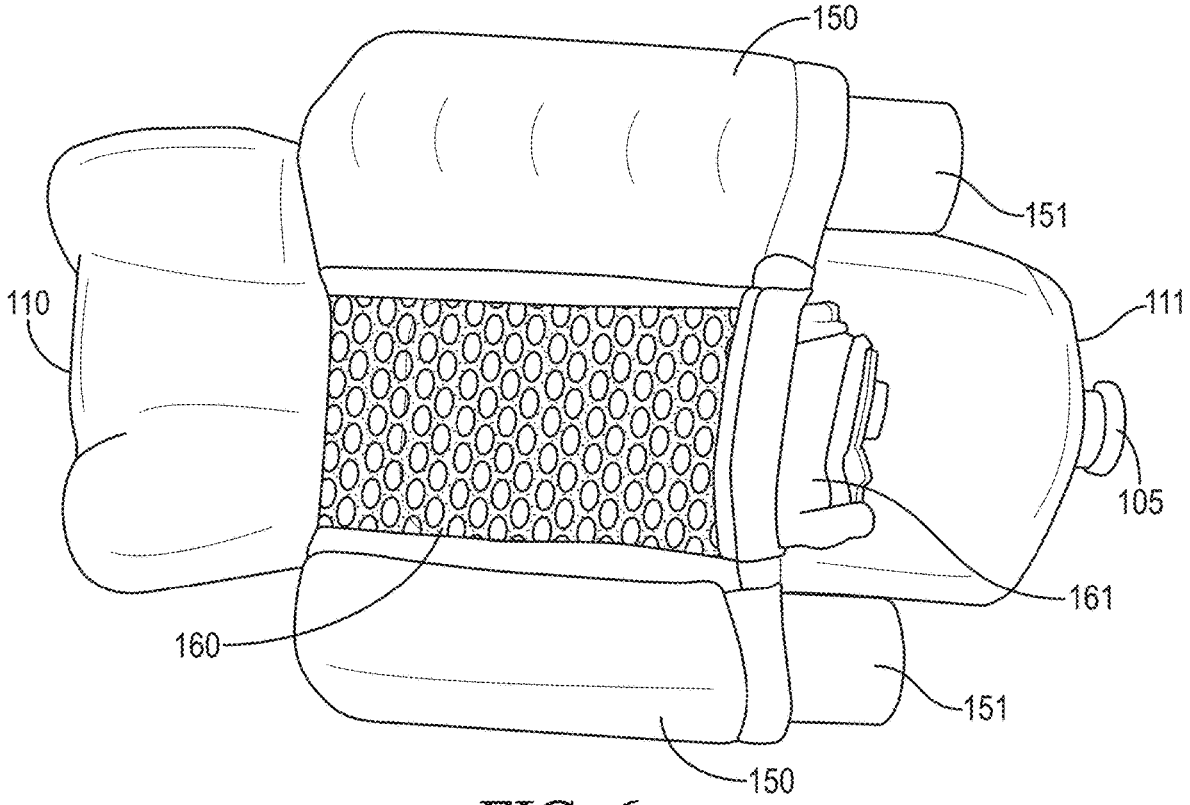
FIG. 6 is a bottom perspective view of the mobile hand cleaning station of FIG. 1.
Figure 7:
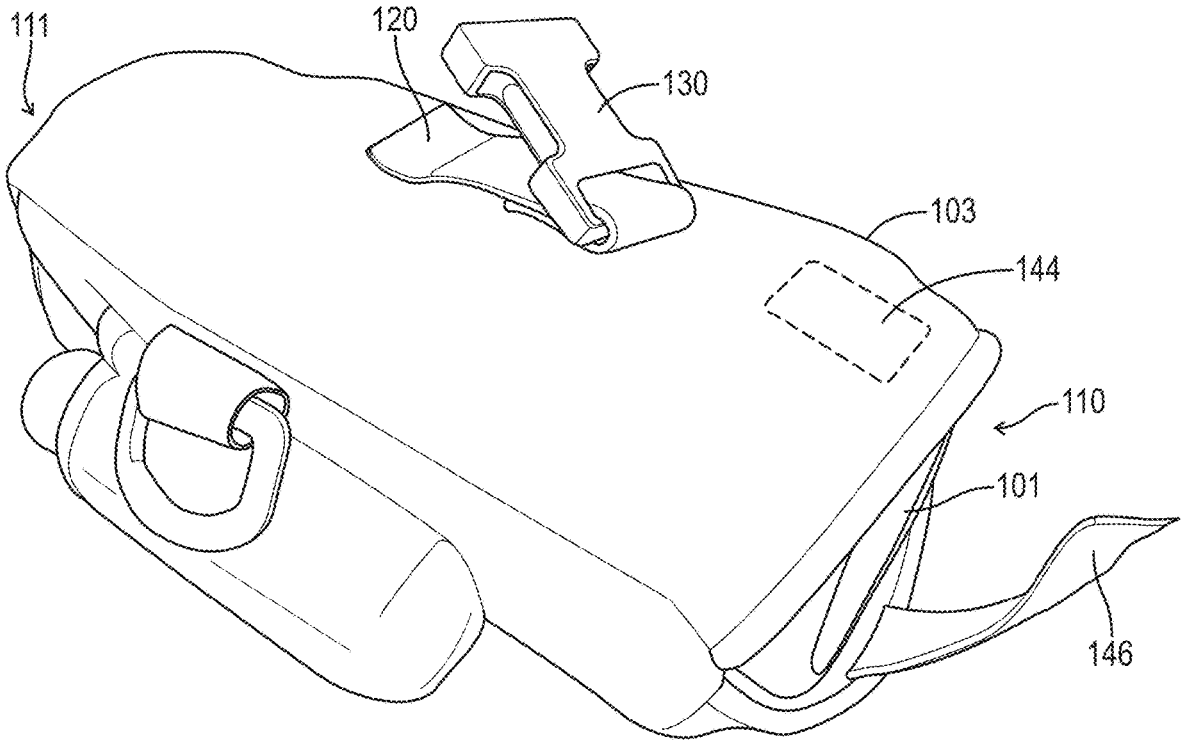
FIG. 7 is an isometric view of the mobile hand cleaning station of FIG. 1.
Figure 8:
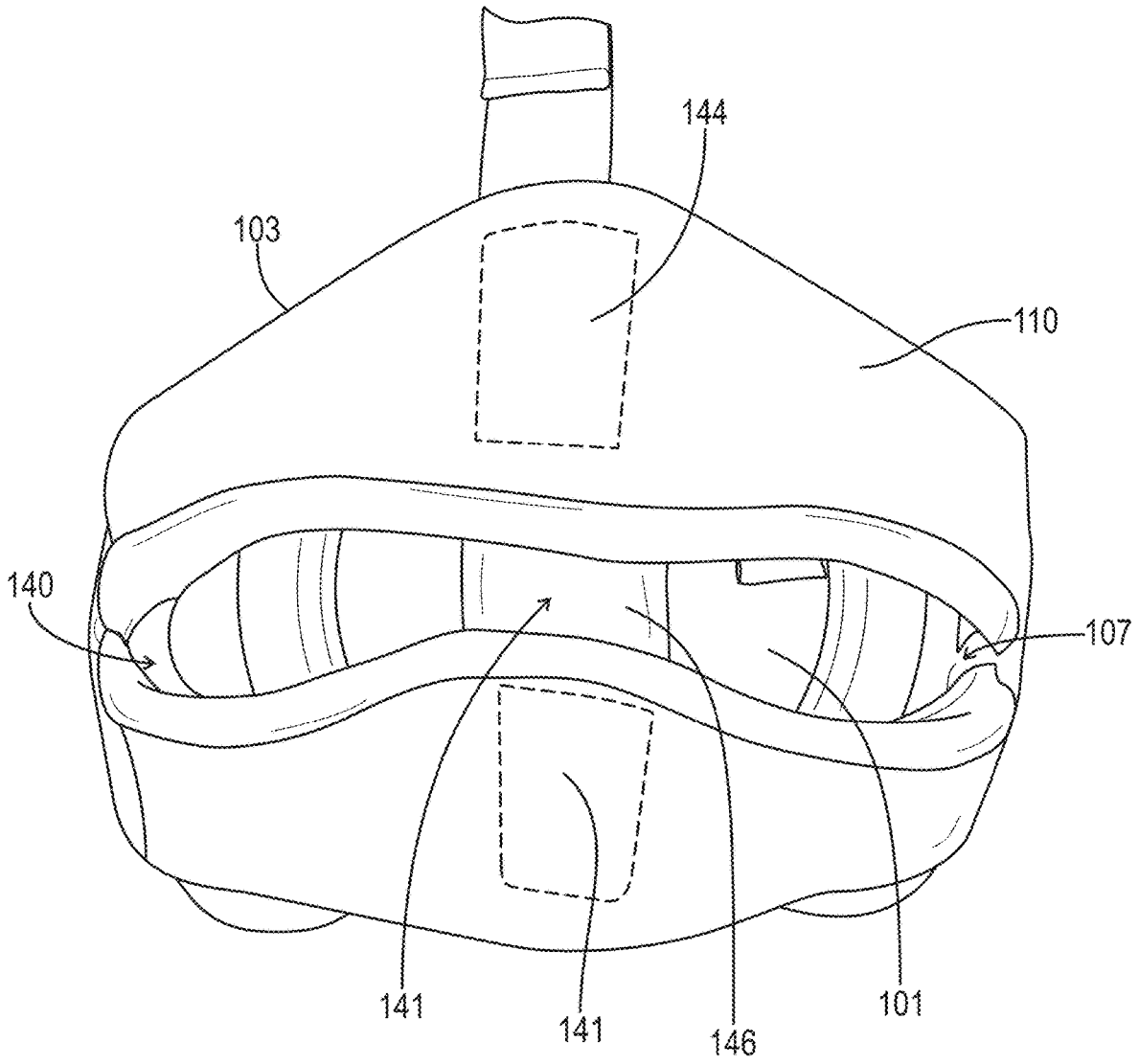
FIG. 8 is an end perspective view of the mobile hand cleaning session of FIG. 1 from a first end of the mobile hand cleaning station.

Referring now to FIGS. 1-8, in one embodiment, a mobile hand cleaning station 100 includes a container flowable product 101 and a carrier 103. In one embodiment, the flowable product is water, hand sanitizer, or soap. The container 101 is configured to receive the flowable product (e.g., the water, hand sanitizer, or so) therein and selectively dispense the flowable product through a dispenser 105 of the container 101. In one embodiment, the dispenser 105 is a pressure actuated automatic valve, and in another embodiment, the dispenser 105 is a manually actuated valve.

The carrier 103 includes a central containment area 107 extending along a longitudinal axis 106 of the container 101 when the container 101 is received in the central containment area 107 of the carrier 103. The central containment area 107 is configured to receive the container 101 of flowable product. The central containment area 107 has a first end 110 and a second end 111 opposite the first end 110. The first end 110 of the central containment area 107 is configured to receive the container 101 into the central containment area 107. The second end 111 of the central containment area 107 has an opening 113 therethrough to receive the dispenser 105 of the container 101 when the container 101 is in the central containment area 107. The opening 113 in the second end 111 of the central containment area 107 does not permit the whole container 101 to pass therethrough such that when the container 101 is inserted into the central containment area 107 through the first end 110 of the central containment area 107, the dispenser 105 passes through the opening 113 and the second end 111 of the central containment area 107, and the container 101 is retained in the central containment area 107 when the first end 110 of the central containment area 107 is closed.

In one embodiment, the first end 110 of the central containment area 107 has a slit 140 therethrough for receiving the container 101 of flowable product into the central containment area 107. In one embodiment, the slit 140 extends completely across the central containment area 107 of the carrier 103 such that when the central containment area 107 is generally cylindrical because a cylindrical container 101 of flowable product is in the central containment area 107, the slit 140 has a length generally equal to a diameter of the central containment area 107. The carrier 103 further includes a closure 141 at the first end 110 of the central containment area 107. The closure 141 is configured to bring a first side 143 of the slit 142 a second side 144 of the slit 140 so as to at least partially close the slit 140 in the first end 110 of the central containment area 107 and retain the container 101 in the central containment area 107. In one embodiment, the closure 141 is a hook and loop fastener pair. One embodiment, the loop portion 146 of the hook and loop fastener pair is elongated and extends from the first side 143 of the slit 140 such that the slit 140 may be fully or partially close to allow for the container 101 to vary in size.

In one embodiment, the carrier 103 includes an attachment point 120 configured to connect to an attachment device 121 of the mobile hand cleaning station 100. The attachment point 120 is located on the carrier 103 between the first end 110 of the central containment area 107 and the second end 111 of the central containment area 107. In one embodiment, the attachment device 121 may be a lanyard 123 or a hook 124. The hook 124 may be an open hook or a closed carabineer spring style hook. In one embodiment, the attachment 0.20 includes first portion 130 of a quick release buckle and the attachment device 121 includes a corresponding second portion 131 of the quick release buckle such that the hook 124 and lanyard 123 are interchangeable at the attachment point 120. The lanyard 123 may fit about a user's neck such that the station 100 hangs from the user's neck, and the hook 124 may clip or hook onto an object to hang the station 100 from the object. In one embodiment, the lanyard 123 includes a safety breakaway. In one embodiment, the attachment point 120 is located on the carrier 103 between about half way between the first end 110 and the second end 111 of the central containment area 107 and the first end 110 of the central containment area 107. Thus, the carrier 103 hangs from the attachment device 121 when the container 101 of flowable product is in the central containment area 107 with the second end 111 of the central containment area 107 below the first end 110 of the central containment area 107 with the longitudinal axis 106 in neither a vertical nor horizontal orientation (see, for example, FIGS. 3 and 4). In one embodiment, the attachment point 120 is located just off center between the first end 110 and the second end 111 of the central containment area 107 toward the first end 110 of the central containment area 107 such that the longitudinal axis 106 is approximately 15° below horizontal.

In one embodiment, the container 101 of flowable product is a first container of flowable product, and the carrier 103 further includes an auxiliary containment area 150 configured to receive and retain a second container 151 of flowable product. In one embodiment, the mobile hand cleaning station 100 further includes the second container 151 of flowable product. The second container 151 of flowable product is smaller than the first container 101 of flowable product such that the auxiliary containment area 150 has a volume less than a volume of the central containment area 107. The auxiliary containment area 150 extends parallel to the longitudinal axis 106 when the first container flowable product 101 is in the central containment area 107. In one embodiment, the auxiliary containment area 150 has a length along the longitudinal axis 106 less than a length of the central containment area 107. The auxiliary containment area 150 is attached to the central containment area 107. In one embodiment, the central containment area 107 at least partially forms a side of the auxiliary containment area 150. In one embodiment, the auxiliary containment area 150 has a smaller cross-sectional area at a second end 152 of the auxiliary containment area 150 corresponding to the second end 111 of the central containment area 107 then at a first end 153 of the auxiliary containment area 150 corresponding to the first end 110 of the central containment area 107 such that when the second container 151 is inserted into the second end 152 of the auxiliary containment area 150, the second container 151 is retained in the auxiliary containment area 150 by the constriction at the second end 152 of the auxiliary containment area 150. In one embodiment, the auxiliary containment area 150 is generally enclosed at the first end 153 of the auxiliary containment area 150. In one embodiment, the auxiliary containment area 150 is generally open at the second end 152 of the auxiliary containment area 150. In one embodiment, the auxiliary containment area 150 is located on the central containment area 107 between 25% of the distance from the second end 111 of the central containment area 107 to the first end 110 of the central containment area 107 and 75% of the distance from the second end 111 of the central containment area 107 to the first end 110 of the central containment area 107. In one embodiment, the auxiliary containment area 150 is longitudinally offset toward the second end 111 of the central containment area 107. In one embodiment, the mobile hand cleaning station 100 includes a plurality of auxiliary containment areas 150 attached to the central containment area 107. In one embodiment, at least one auxiliary containment area 160 of the plurality of exhilarate containment areas is formed at least partially of mesh such that a tile 161 inserted into the at least one auxiliary containment area 160 is exposed to air such that the tile 161 is able to drive. In one embodiment, the mobile hand cleaning station 100 further includes the tile 161.

In one embodiment, the carrier 103, and more particularly the central containment area 107, is formed generally (i.e., at least partially) of a stretchable fabric such as neoprene. In one embodiment, portions of the carrier such as the attachment point 120 are formed of nylon webbing. In one embodiment, portions of the carrier 103 such as one or more auxiliary containment areas are formed of mesh.

The downward orientation of the carrier 103 when hung from the attachment device 121 points the dispenser or valve 105 in a visible direction and away from a user when the attachment device 121 is the lanyard 123. The user can use their forearms to squeeze the flexible carrier 103 and dispense water from the container 101. Soap or antibacterial treatment may be similarly dispensed by squeezing the carrier 103 at the auxiliary containment areas 150. Multiple products may be dispensed simultaneously if multiple valves are left open, or the user may selectively open and close valves after removing the bulk of the contaminants from the user's hands by dispensing a quantity of fluid from the container 101 in the central containment area 107 (e.g., water).

In one embodiment, the slit 113 in the second end 111 of the central containment area 107 is substantially smaller than the slit 140 at the first end 110 of the central containment area 107 such that various containers 101 may be received and retained in the central containment area 107. It is contemplated within the scope of the claims that the slit 113 and the second end 111 of the central containment area may be generally circular.

In one embodiment, the containment areas 107, 150 may be described as pockets, sleeves, or pouches that generally take the shape of the object inserted into them. In one embodiment, openings or slits in the containment areas are reinforced with trim and additional stitching.

In one embodiment, the central containment area 107 has an overall length of approximately 7 inches. Each auxiliary containment area 150 has an overall length of approximately 3.25 inches. The second end of each auxiliary containment area is set back longitudinally from the second end 111 of the central containment area 107 by about 1.75 inches such that the first end of the each auxiliary containment area 150 is approximately 2 inches from the first end 110 of the central containment area 107. A pair of auxiliary containment areas 150 are offset from one another about the central containment area 107 by less than 180 degrees (each being closer to a bottom of the central containment area 107 than a top), and an additional mesh auxiliary containment area is located on the central containment area between the pair of opposing auxiliary containment areas. In one embodiment, each auxiliary containment area 150 has a cross sectional area of approximately 1.5 inches squared and the central containment area 107 has a diameter of approximately 2.75 inches. In one embodiment, the carrier 103 further includes a ring to receive the hook 124 when the hook 124 is not attached to the attachment point 120 such that the hook 124 is retained with the carrier 103 and not misplaced.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MOBILE HAND CLEANING STATION it is not intended that such references be construed as limitations upon the scope of this invention except as set forth in the following claims.

What is claimed is:

1. A mobile hand cleaning station, said station comprising:

a container of flowable product comprising a dispenser, said container configured to receive a flowable product therein and selectively dispense said flowable product through the dispenser and said container extending along a longitudinal axis;

a carrier comprising a central containment area extending along the longitudinal axis of the container when the container is in the central containment area, wherein:

the central containment area is configured to receive the container of flowable product;

the central containment area has a first end configured to receive the container into the central containment area;

the central containment area has a second end opposite the first end, said second end having an opening therethrough to receive the dispenser of the container when the container is in the central containment area; and the opening in the second end of the central containment area does not permit the whole container to pass therethrough such that when the container is inserted into the central containment area through the first end of the central containment area, the dispenser passes through the opening in the second end of the central containment area and the container is retained in the central containment area;

an attachment device;

a towel; and an attachment point corresponding to the attachment device, wherein the attachment point is configured to connect to the attachment device of the mobile hand cleaning station, wherein said attachment point is located on the carrier between the first end of the central containment area and the second end of the central containment area, wherein:

the carrier further comprises a plurality of auxiliary containment areas attached to the central containment area; and at least one auxiliary containment area of the plurality of auxiliary containment areas is formed at least partially of mesh such that the towel, when inserted into said at least one auxiliary containment area is exposed to air such that the towel is able to dry.

2. The mobile hand cleaning station of claim 1, further comprising:

the attachment device, wherein the attachment device is one of a lanyard configured to selectively attach to the attachment point or a hook configured to selectively attach to the attachment point; wherein:

the attachment point is a portion of a quick release buckle.

3. The mobile hand cleaning station of claim 1, wherein:

the attachment point is located on the carrier between about halfway between the first end and the second end of the central containment area and the first end of the central containment area such that the carrier hangs from the attachment device when the container of flowable product is in the central containment area with the second end of the central containment area below the first end of the central containment area with the longitudinal axis in neither a vertical nor horizontal orientation.

4. The mobile hand cleaning station of claim 1, wherein:

the attachment point is located about halfway between the first end of the central containment area and the second end of the central containment area.

5. The mobile hand cleaning station of claim 1, wherein:

the first end of the central containment area has a slit therethrough for receiving the container of flowable product into the central containment area;

the carrier further comprises a closure at the first end of the central containment area; and the closure is configured to bring a first side of the slit to a second side of the slit so as to, at least partially, close the slit in the first end of the central containment area.

6. The mobile hand cleaning station of claim 1, wherein:

the first end of the central containment area has a slit therein for receiving the container of flowable product into the central containment area;

the carrier further comprises a closure at the first end of the central containment area;

the closure is configured to bring a first side of the slit to a second side of the slit so as to, at least partially, close the slit in the first end of the central containment area;

the closure comprises a hook and loop fastener pair; and the loop portion of the hook and loop fastener pair is elongated and extends from the first side of the slit such that the slit may be fully or partially closed to allow for the container to vary in size.

7. The mobile hand cleaning station of claim 1, wherein:

the container of flowable product is generally cylindrical; and the central containment area of the carrier comprises a slit extending completely across the central containment area of the carrier such that when the central containment area is generally cylindrical because the generally cylindrical container of flowable product is in the central containment area, the slit has a length generally equal to a diameter of the central containment area.

8. The mobile hand cleaning station of claim 1, wherein the carrier further comprises an auxiliary containment area, wherein:

the container of flowable product is a first container of flowable product;

the auxiliary containment area is configured to receive and retain a second container of flowable product;

the second container of flowable product is smaller than the first container of flowable product such that the auxiliary containment area has a volume less than a volume of the central containment area;

the auxiliary containment area extends parallel to the longitudinal axis;

the auxiliary containment area has a length less than a length of the central containment area;

the auxiliary containment area is attached to the central containment area;

the central containment area at least partially forms a side of the auxiliary containment area;

the auxiliary containment has a smaller cross sectional area at a second end of the auxiliary containment area corresponding to the second end of the central containment area than at a first end of the auxiliary containment area corresponding to the first end of the central containment area;

the auxiliary containment area is generally enclosed at the first end of the auxiliary containment area; and the auxiliary containment area is generally open at the second end of the auxiliary containment area.

9. The mobile hand cleaning station of claim 1, wherein the carrier further comprises an auxiliary containment area, wherein:

the container of flowable product is a first container of flowable product;

the auxiliary containment area is configured to receive and retain a second container of flowable product;

the second container of flowable product is smaller than the first container of flowable product such that the auxiliary containment area has a volume less than a volume of the central containment area;

the auxiliary containment area extends parallel to the longitudinal axis;

the auxiliary containment area has a length less than a length of the central containment area;

the auxiliary containment area is located on the central containment area between 25% of the distance from the second end of the central containment area to the first end of the central containment area and 75% of the distance from the second end of the central containment area to the first end of the central containment area;

the auxiliary containment area is offset longitudinally toward the second end of the central containment area; and the mobile hand cleaning station further comprises the second container of flowable product.

10. The mobile hand cleaning station of claim 1, wherein the central containment area of the carrier is formed, at least partially, of neoprene.

* * * * *